United States Patent [19]

Brunner et al.

[11] Patent Number: 4,461,222

[45] Date of Patent: Jul. 24, 1984

[54] INSTALLATION FOR PROTECTION AGAINST BREAK-INS

[75] Inventors: Jean-Michel Brunner; Daniel Deschamps, both of Trappes, France

[73] Assignee: Fichet-Bauche, Velizy, France

[21] Appl. No.: 340,864

[22] Filed: Jan. 20, 1982

[30] Foreign Application Priority Data

Jan. 28, 1981 [FR] France ..... 81 01647

[51] Int. Cl.[3] ..... E05G 1/12

[52] U.S. Cl. ..... 109/29; 109/20; 109/77

[58] Field of Search ..... 109/20, 29, 30, 34, 109/75, 77, 68; 521/917; 99/477

[56] References Cited

U.S. PATENT DOCUMENTS

| | | | |
|---|---|---|---|
| 19,923 | 4/1858 | Garlick | 109/68 |
| 952,980 | 3/1910 | Damon | 109/68 |
| 1,471,517 | 10/1923 | Kline | 109/77 |
| 1,868,485 | 7/1932 | Bates, Jr. | 109/75 |
| 1,887,866 | 11/1932 | Belknap | 109/68 |
| 2,629,905 | 3/1953 | Kessler et al. | 49/477 |
| 2,979,246 | 4/1961 | Liebeskind | 521/917 |
| 3,057,321 | 10/1962 | Pretini | 109/31 |
| 3,172,925 | 3/1965 | Preotle | 521/917 |
| 3,230,912 | 1/1966 | Hohmann | 109/20 |
| 3,442,453 | 5/1969 | Whitehouse, Jr. | 521/917 |
| 3,451,786 | 6/1969 | Perrin | 521/917 |
| 4,073,521 | 2/1978 | Mena | 49/477 |
| 4,202,279 | 5/1980 | Rand | 109/34 |
| 4,236,463 | 12/1980 | Westcott | 109/33 |

FOREIGN PATENT DOCUMENTS

| | | | |
|---|---|---|---|
| 709513 | 8/1941 | Fed. Rep. of Germany | 49/471 |
| 7902960 | 10/1980 | Netherlands | 109/75 |
| 462925 | 4/1975 | U.S.S.R. | 109/75 |

*Primary Examiner*—Paul J. Hirsch

*Attorney, Agent, or Firm*—Sandler & Greenblum

[57] ABSTRACT

In the event of an alarm being raised (e.g. by a sensor 34) by an attempt at breaking into a protected space (36) such as a safe or a strong room, a rapidly hardening foam is suddenly projected around or into the space to be protected. The expanding foam can also be used to drive additional door-barring means into position. The foam may be made by mixing two components that react together. The components can then be stored in tanks (23, 24), where they occupy little volume until the alarm is raised. The components are mixed in a mixing head (27) and projected into the space through a nozzle (28).

22 Claims, 11 Drawing Figures

FIG. 1
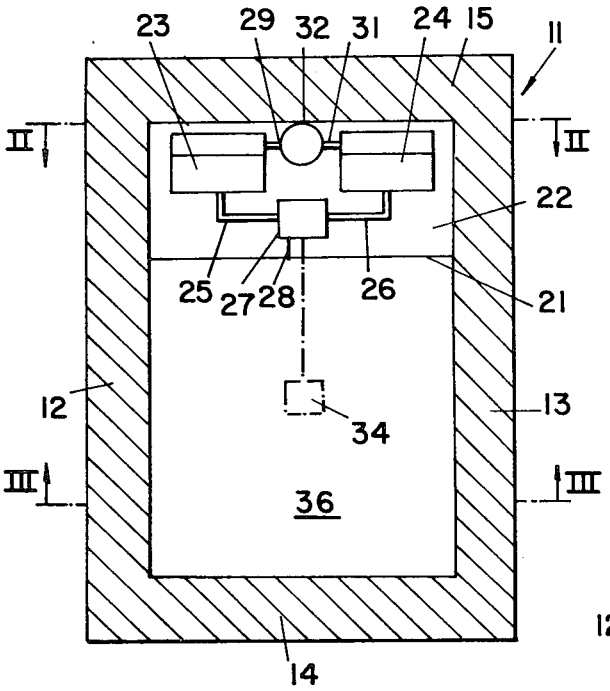
FIG. 3
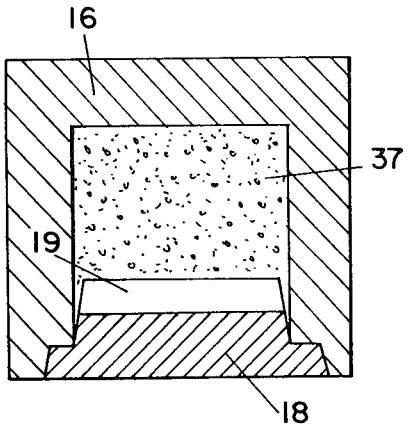
FIG. 4
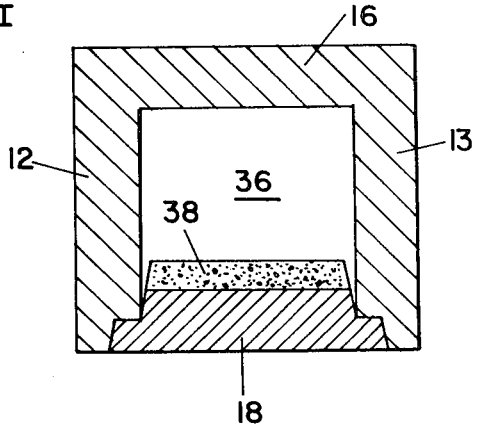
FIG. 5
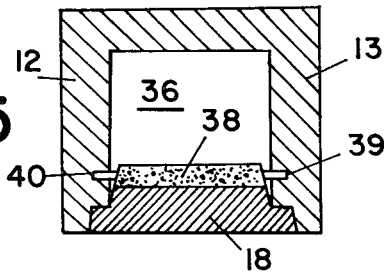
FIG. 6
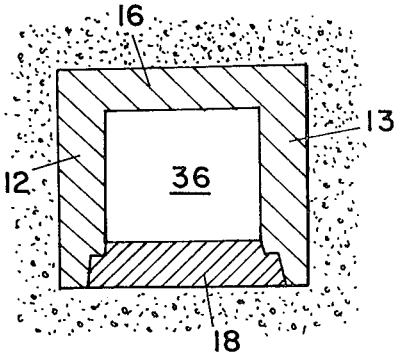
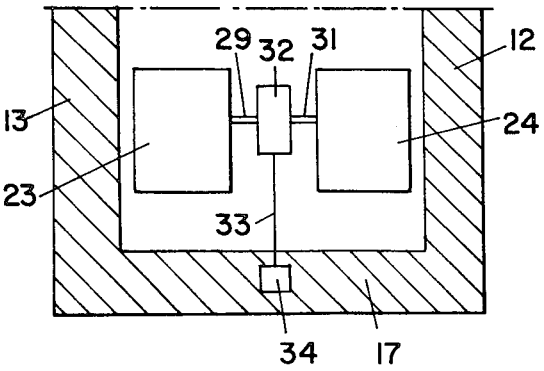
FIG. 2

INSTALLATION FOR PROTECTION AGAINST BREAK-INS

The present invention relates to an installation for providing protection against break-ins.

BACKGROUND OF THE INVENTION

Often, a user desires to supplement such protection as may be provided by physical means for preventing access, by using an alarm signal that is triggered by an attempt at breaking in.

Brief-cases or the like for transporting documents of value are also known in which means are provided for destroying the documents, or at least rendering them un-useable, in the event of an attempt at breaking the case or at forcing it open.

SUMMARY OF THE INVENTION

The present invention provides a method of protecting a space from access by an unauthorised person, wherein the method comprises providing foam forming means in the vicinity of the space to be protected, and using said means to rapidly and irreversibly form a hardening foam whose volume is considerably greater than that of the foam forming means.

The invention also provides an installation, a safe, a strong room, a door and a vehicle which implement the method.

It will be observed that the present invention is based on the idea of protecting an object or a group of objects by interposing an additional barrier (the hardening foam) between said object(s) and the access to their location. Said foam barrier is such that its presence prevents, or at least delays, approach to and/or retrieval of the object(s).

The invention relies on the fact that it is now possible to use components that can be stored in relatively small volumes to suddenly create a foam that occupies a relatively large volume or area. The invention thus takes advantage of the fact that a given volume of foam can be made from components which occupy a volume that is several tens of times smaller. Particularly suitable in this respect are those foam materials which are currently obtained industrially by mixing two components: e.g. by mixing a first component comprising one or more polyols with a second component comprising one or more isocyanates to obtain a polyurethane foam.

Preferred foams harden in a very short time, e.g. in about one minute.

The present invention is thus different from prior proposals in which protection is obtained by forming a viscous and sticky foam which, when deposited on tools, makes them difficult to grasp and hence to use. Such a foam does not act by virtue of its hardness nor its volume.

Further, the formation of a protective hardening foam in accordance with the present invention is irreversible, as opposed to other means for providing protection which can be returned to an initial position or condition in which they are inoperative.

The presence of the protective hardening foam should prevent or delay a thief in his effort to obtain the object(s) to be protected. Said foam hides the object(s) from the thief, thereby making them harder to grasp.

In another implementation, the protective foam is formed without using a chemical reaction: the protective foam-making material is stored under pressure in as small a volume as possible, and in operation it is projected to generate a bulky hardening foam.

In one embodiment of an installation in accordance with the invention, the installation comprises a storage tank for a first component, a storage tank for a second component, and means actuated by an attempted break-in or like action, to trigger the reaction between said components to form a hardening foam between a thief and the object to be protected.

The invention also provides for action in which the expanding foam is used to move mechanical members, e.g. made of metal, to provide a mechanical bar to obtaining access to the objects to be protected.

BRIEF DESCRIPTION OF THE DRAWINGS

The following description, given by way of example, makes reference to the accompanying drawings, in which:

FIG. 1 is a diagrammatic vertical section through a safe equipped with an installation in accordance with the invention;

FIG. 2 is a diagrammatic section along a line II—II of FIG. 1;

FIG. 3 is a section along a line III—III of FIG. 1, but in which the depth and the width have been reduced;

FIG. 4 is a similar view of FIG. 3, but shows a variant;

FIG. 5 is a similar view to FIG. 4, but shows a variant of that figure;

FIG. 6 is a similar view to FIGS. 3 to 5, but shows another embodiment;

MORE DETAILED DESCRIPTION

Figure 7:
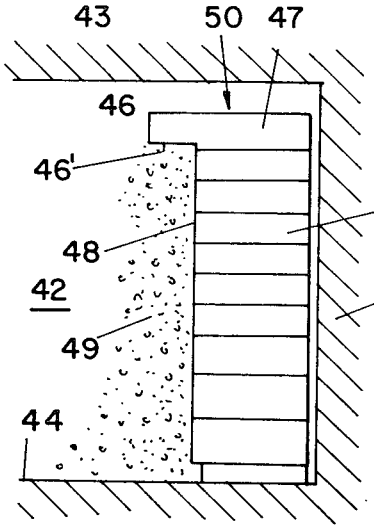
FIG. 7 is a diagrammatic vertical section through part of a strong room housing deposit boxes, showing how the protection is applied.

With reference to FIGS. 1 to 3, a safe comprises strong side walls 12 and 13, a strong bottom wall 14, a strong top wall 15, a strong back wall 16 and a strong front wall 17 fitted with a strong door 18 having locking means 19 mounted on the back face thereof. A horizontal partition 21 is fitted close to the top wall 15, defining an upper compartment 22 inside the safe. The height of the upper compartment 22 is exaggerated in FIG. 1 for the sake of clarity in the drawing.

The compartment 22 houses a first tank 23 containing a first component, e.g. poloyol, and a second tank 24 containing a second component, e.g. an isocyanate. Tubes 25 and 26 connect the tanks 22 and 24 respectively to a mixer head 27 having a projection nozzle 28 directed downwardly through the partition 21. The upper parts of the tanks 22 and 23 are connected via respective tubes 29 and 31 to a cartridge of compressed air 32 which is triggered via an electrical conductor 33 connected to a detector 34 located inside the door 18.

Operation is as follows:

When the detector 34 is triggered by an attempted break-in, compressed air from the cartridge 32 suddenly ejects the liquids contained in the tanks 23 and 24 so that they react together in the mixer head 27. Abundant foam is injected into the empty space 26 inside the safe via the nozzle 28. The foam requires only a short period of time, about one or two minutes, to harden, so that if the thief does manage to gain access to the space 36, he will find himself facing a hard mass of foam hiding any objects that may be contained in the safe, thereby preventing them from being removed.

The thief can only get at the objects by dint of extra work that is both long and hard. This work is made all the more discouraging by the fact that the thief does not know whether there is actually anything at all hidden in the hardened foam, referenced 37 in FIG. 3, nor does he know where to start searching therein.

In a variant, the compartment in which the tanks are housed is in the lower part of the safe, and the mass of hardening foam is ejected upwardly from the upper surface of a partition defining the lower compartment.

In the embodiment shown in FIG. 4, the mass of hardening foam is injected, in the event of an attempted break-in, into a compartment or lock box 38 housing the locking mechanism. The foam stops the locking mechanism from working, and thus renders useless any key which a thief may have obtained fraudulently.

In the variant shown FIG. 5, the foam expanding inside the lock box 38 expels bolts 39 which are received in cavities 40 provided in the strong walls 12 and 13, thereby irreversibly locking the door 18 shut. As can be clearly seen from FIG. 5, each bolt has a first end located within the interior of the lockbox and a second end adapted to be positioned in a recess in a wall of the box. When the foam expands, it urges against the first ends of the bolts to push them towards receiving holes of respective container walls.

With reference to the embodiment shown in FIG. 6, the foam is projected to cover the outside walls of the safe (except for its bottom wall which is resting on the floor), thereby hindering the application of safe-breaking tools to the safe. If the thief tries using a blow-torch, the gasses given off by the burning foam should have a dissuasive effect.

Further, if the thief is close to the safe when the foam is projected in liquid form, he will be covered in foam which will harden on his clothes, thereby hindering his movements, and drawing attention to himself if he makes a get away.

Reference is now made to FIG. 7. Deposite boxes 41 for storing valuable objects or documents are arranged in a column 50 in a strong room 42. The strong room 42 has a strong upper wall or ceiling 43, a strong lower wall or floor 44, and a strong vertical wall 45 against which the column 50 is placed. The top box 47 has a forwardly projecting overhang 46 housing tanks similar to those shown in FIGS. 1 and 2. The components that they contain are projected via a nozzle 46' to form a foam in front of the front face 48 of the boxes in the event that an alarm is triggered either by the thief himself or by an official. A thick layer 49 of hardening foam is formed in front of the face 48, with the bottom of the layer 49 being thicker than the top. The layer 49 prevents direct access to the doors of the boxes 41 which doors are located in the front face 48 of the column, and the thicker lower portion of the foam layer hinders a thief's approach to the boxes.

Figure 8:
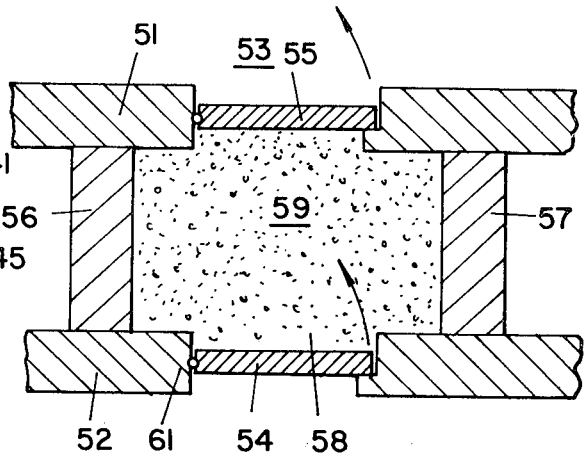
FIG. 8 is a diagrammatic horizontal section through a double-walled strong room, in the vicinity of an air lock.

Reference is now made to FIG. 8. In this embodiment, the strong room is a double-walled strong room, i.e. it has a strong inner wall 51 and a strong outer wall 52. Access to the inside 53 of the strong room is controlled by an outer door 54 and an inner door 55 which, together with two strong walls 56 and 57 disposed perpendicularly to the walls 51 and 52, delimit an air lock 58.

In the event of an alarm, a block of hardening foam 59 is formed inside the air lock 58, either over its full height, or only over a portion of its height. In the first place, said block 59 provides a material obstacle to opening the outer door 54 which is hung on a hinge 61 to open into the air lock (as shown by an arrow), and in the second place said block prevents, or considerably hinders, passage through the air lock 58 to gain access to the inner door 55, even after the outer door 54 has been opened.

In another embodiment, the foam is projected over the floor of the strong room itself, partially or completely filling its inside volume 53. If projection takes place while thieves are inside the strong room their movements are hampered; the layer of hard foam which forms on their clothes gets in the way of their movements and draws attention to them if they manage to leave the strong room.

Figure 9:
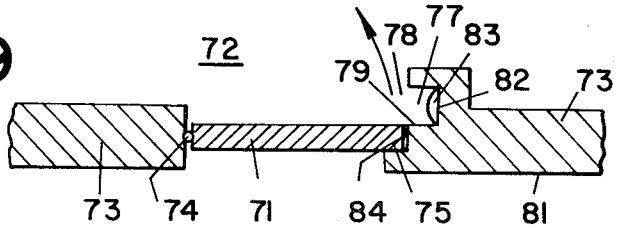
FIG. 9 is a diagrammatic horizontal section through an entrance to a location via a door equipped with an installation in accordance with the invention.
Figure 10:
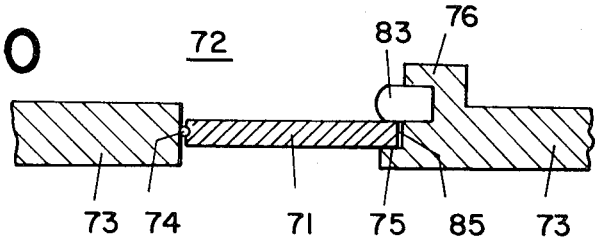
FIG. 10 is a similar view to FIG. 9, but shows the installation in the operated position.

Reference is now made to FIGS. 9 and 10. A door 71 controls access to the inside 72 of a strong room or other location, through a wall 73 which may be strong. The door 71 is hinged about an axis 74, and its other edge co-operates with a door frame 75 forming part of the wall 73.

The wall 73 has a projecting portion 76 on its inside face, providing a vertical groove 77 delimited by a bottom 82 and two sides 78 and 79 parallel to the wall 73. An elongate bag 83 lines the bottom of the groove 77 and extends along at least a major part of the height of the door. In the collapsed position, the bag 83 does not project beyond the inside edge 84 of the door sill, against which the rim 85 of the door 71 rests in the closed position.

In the event of an alarm, the bag 83 is inflated by an inrush of foam under pressure, thereby occupying the position shown in FIG. 10. Once it has hardened, the bag constitutes a rigid bar projecting over the edge of the door 71 to oppose the door being opened by rotation about the hinge 74.

In another embodiment, the expanding bag drives metal members to bar the door even more firmly, somewhat along the lines described with reference to FIG. 5.

In all the embodiments described above, the foam could be formed by projecting a foaming liquid from a single pressurized tank, instead of being formed in situ by reacting two or more components.

Figure 11:
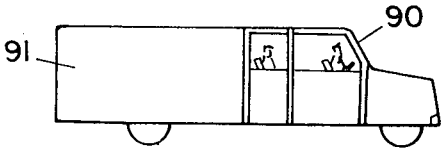
FIG. 11 is a diagram of a vehicle for transporting funds and incorporating the invention.

The invention is also applicable to vehicles for transporting funds, e.g. one of the type shown diagrammatically in FIG. 11.

Such a vehicle has an armoured housing or cab 90 suitable for seating three or four persons for example, and a separate compartment 91 for receiving funds or other valuables to be transported. The separate compartment 91 is equipped with an installation in accordance with the invention for filling its inside volume at least partially with the protective foam, and/or for preventing the access door(s) to the compartment from being opened.

We claim:

1. A method of protecting an article-containing space from access by an unauthorized person, said method comprising:

(a) sensing attempted unauthorized entry into said space with a detector;

(b) rapidly and irreversibly filling at least a portion of said space with a hardenable foam adapted to form a rigid mass occupying a defined volume and activated by said detector in response to said sensing, said portion having a volume substantially greater than that of means for forming said foam and greater than that occupied by any article located within said space.

2. A method in accordance with claim 1 wherein said space to be protected is completely filled with said hardenable foam.

3. A method in accordance with claim 1 wherein said space to be protected is only partially filled with said hardenable foam.

4. a method in accordance with claim 1 wherein the area surrounding any articles in said space is filled with said surrounding any articles in said space is filled with said hardenable foam.

5. A method in accordance with claim 1 further comprising making said hardenable foam from a plurality of separately stored components.

6. A method in accordance with claim 1 further comprising making said hardenable foam by expanding a pressurized fluid.

7. A method in accordance with claim 6 wherein said space comprises an enclosed volume containing locking means for preventing access to said volume, said method further comprising barring access to said space by expanding said foam to drive said locking means into a position expanding said foam to drive said locking means into a position in which they prevent entry to said space by preventing any access doors around said space from opening.

8. Apparatus for protecting an article-containing space from unauthorized entry, said apparatus comprising:

(a) means for detecting attempted unauthorized entry into said space; and (b) means for rapidly forming a foam in response to detection of said attempted unauthorized entry by using said detecting means to activate said foam forming means, said foam forming means including means for filling at least a portion of said article-containing space with hardenable foam which prevents access to said space when said foam is expanded, said foam adapted to form a rigid mass occupying a defined volume when expanded.

9. Apparatus in accordance with claim 8, said foam forming means comprising means for storing one or more hardenable foam producing agents in condensed form.

10. Apparatus in accordance with claim 9 wherein said storing means comprise tanks for storing components which form the hardenable foam when mixed together.

11. Apparatus in accordance with claim 10 including means for conducting said components to a mixer head and for projecting a mixture of said components from said mixer head towards the interior of said space to be protected.

12. Apparatus in accordance with claim 11 wherein said projecting means includes a cartridge of compressed air.

13. Apparatus in accordance with claim 12, said space comprising the interior of a safe.

14. Apparatus in accordance with claim 13, said projecting means being adapted to fill at least a portion of the interior volume of said safe with hardenable foam.

15. Apparatus in accordance with claim 14, said safe having a door with a locking mechanism thereon and a lockbox therein, said projecting means having being adapted to fill said locking mechanism with hardenable foam, said hardenable foam, when expanded, being adapted to secure said locking means in a locking position.

16. Apparatus in accordance with claim 15, said lockbox also comprising door-locking bolts adapted to be driven outwardly into a door-locking position under pressure exerted by said foam when said foam forms and expands within said lockbox in order to minimize unauthorized entry into said space.

17. Apparatus in accordance with claim 35, said space comprising the interior of a room.

18. Apparatus in accordance with claim 17, said room including two walls which are spaced apart with an air-lock entrance positioned between them, said projecting means being adapted to at least partially fill said air-lock with hardening foam.

19. Apparatus in accordance with claim 18, said room including a door, said hardening foam comprising means for hindering opening of said door when it is foamed.

20. Apparatus in accordance with claim 19, said apparatus further comprising door-barring mechanical means which are adapted to be moved into a door-barring position in response to expansion of said hardening foam, and an inflatable bag which does not prevent the door from opening when uninflated, said bag being adapted to be inflated by said hardenable foam in response to detection of unauthorized entry, thus comprising means for hindering opening of said door.

21. Apparatus in accordance with claim 20, said bag being housed within a groove in a vertical edge of said door frame.

22. Apparatus in accordance with claim 9, said space comprising the interior of a vehicle for transporting valuable items, said vehicle including a valuable-containing compartment for surrounding said space.

* * * * *

UNITED STATES PATENT AND TRADEMARK OFFICE

CERTIFICATE OF CORRECTION

PATENT NO. : 4,461,222

DATED : July 24, 1984

INVENTOR(S) : Jean-Michel BRUNNER et al.

It is certified that error appears in the above-identified patent and that said Letters Patent is hereby corrected as shown below:

Column 5, line 19, delete line 3 of claim 4, which reads "said surrounding any articles in said space filled with".

Column 5, line 17, change "a" to ---A---.

Signed and Sealed this

*Fifth* Day of *March 1985*

[SEAL]

*Attest:*

DONALD J. QUIGG

*Attesting Officer* *Acting Commissioner of Patents and Trademarks*